US005929758A

United States Patent [19]

Eslambolchi et al.

[11] Patent Number: 5,929,758

[45] Date of Patent: Jul. 27, 1999

[54] METHOD AND APPARATUS FOR ACHIEVING PARALLEL CABLE BORING

[75] Inventors: Hossein Eslambolchi, Basking Ridge, N.J.; John Sinclair Huffman, McDonough, Ga.

[73] Assignee: AT&T Corp, Middletown, N.J.

[21] Appl. No.: 08/959,873

[22] Filed: Oct. 29, 1997

[51] Int. Cl.[6] ..... G08B 21/00

[52] U.S. Cl. ..... 340/540; 175/45; 175/67; 340/661; 340/662

[58] Field of Search ..... 340/540, 661, 340/662; 175/45, 62, 67; 324/326

[56] References Cited

U.S. PATENT DOCUMENTS

| | | | |
|---|---|---|---|
| 4,652,861 | 3/1987 | Domes | 340/540 |
| 4,755,805 | 7/1988 | Chau | 340/662 |
| 5,027,108 | 6/1991 | Gray | 340/662 |
| 5,279,373 | 1/1994 | Smet | 175/67 |
| 5,684,466 | 11/1997 | Keating et al. | 340/661 |
| 5,725,059 | 3/1998 | Kuckes et al. | 175/45 |
| 5,757,190 | 5/1998 | Mercer | 175/45 |

*Primary Examiner*—Jeffery A. Hofsass
*Assistant Examiner*—John Tweel, Jr.
*Attorney, Agent, or Firm*—Robert B. Levy

[57] ABSTRACT

The position of a boring head (16) during boring operation in the vicinity of an existing utility conveyance (22) that radiates a locating signal can be determined by establishing the ratio of the strength of the locating signal of the cable induced in the boring head to the strength of the locating signal on the conveyance. Should the ratio exceed a prescribed value, indicating that the boring head is too close to the existing conveyance, then an alert is generated. Advantageously, the position of the boring head during a boring operation may be controlled in feed-back loop fashion in accordance with the ratio to maintain the boring head substantially parallel to the existing conveyance.

13 Claims, 1 Drawing Sheet

METHOD AND APPARATUS FOR ACHIEVING PARALLEL CABLE BORING

TECHNICAL FIELD

This invention relates to a technique for accomplishing a cable boring operation substantially parallel to an existing underground utility conveyance.

BACKGROUND ART

Utilities, such as those providing electric, gas, water and telephone service, often bury their conveyances (i.e., pipes and/or cables) underground for reasons of safety and aesthetics. Usually, the environment and terrain dictate the type of method employed for burying such conveyances. In rural areas, utilities prefer direct burial which they accomplish by plowing or trenching the earth. In urban environments, and when crossing waterways, boring is preferred. To complete such a boring operation, the utility, or a contractor under its employ, first excavates a pit at each of the opposite ends of the intended route for the conveyance. From the one pit, a boring machine (auger) forces a boring head horizontally through the earth into the other pit to create a tunnel through which a utility conveyance can pass.

Underground utility conveyance burial by boring does create a certain risk. An operator must carefully control the path of the boring head to avoid contact with one or more existing underground utility conveyances buried in proximity to the path created by the boring head. For this reason, many utilities, such as AT&T, have regulations governing the minimum allowable distance permitted between the boring head and an existing underground utility conveyance. To facilitate control of the boring head, most boring head manufacturers provide a transmitter (hereinafter referred to as a "sonde") in the boring head for transmitting a signal in the range of 33 Hz. to 9 kHz. The signal transmitted by the sonde radiates through the ground for detection by one or more receivers located above ground. By monitoring the signal radiated by the sonde in the boring head, the operator of the boring machine determines the relative position of the boring head as it bores a path through the earth to avoid contact with an existing underground utility conveyance.

Unfortunately, the signal radiated by the sonde head tends to induce electromagnetic signals in other facilities, such as other underground utility conveyances, causing one or more of them to radiate signals in the vicinity of the conveyance of interest. The receiver(s) tuned to receive the signal radiated by the sonde also receive the signals induced in, and radiated by, such other facilities, causing confusion regarding the actual position of the boring head. Since many boring operations occur in close proximity to existing underground utility conveyances, an error in determining the relative position of the boring head can prove disastrous. Indeed, boring operations have damaged existing underground conveyances, leading to service outages and lost revenues, not to mention the cost associated with repairs.

Thus, a need exists for providing an alert when a boring head lies within the minimum allowable distance from an existing underground utility conveyance, thereby avoiding damage to the conveyance

BRIEF SUMMARY OF THE INVENTION

Briefly, the present invention provides a technique for generating an alert during a boring operation when the boring head is within a minimum allowable distance from an existing underground utility conveyance. The method takes advantage of the fact that a typical existing underground utility conveyance radiates a locating signal that is unique to the service provider maintaining the conveyance. In accordance with the invention, the strength of the locating signal is monitored at the existing conveyance of interest, typically by means of an inductive clamp or the like for releasable attachment to the conveyance. The strength of the locating signal radiated by the existing conveyance of interest is also monitored at the boring head, typically by way of a second inductive clamp. The signal detected at the existing utility conveyance serves as a reference value with regard to the strength of the signal detected at the boring head. If the signal detected at the boring head exceeds a prescribed fraction of the strength of the signal detected at the existing conveyance, then the boring head is too close (i.e., within the minimum allowable distance from the existing conveyance) and an alert is generated.

In accordance with another aspect of the invention, the operation of the boring head may advantageously be controlled, in accordance with the strength of the locating signal, as detected at the boring head, in comparison to the strength of the locating signal detected at the conveyance. By controlling the boring head during boring such that the strength of the locating signal detected at the boring head is maintained at a relatively constant level relative to the signal detected at the conveyance, the boring head will bore substantially parallel to the conveyance. In this way, no damage occurs to the conveyance.

DETAILED DESCRIPTION

Figure 1:
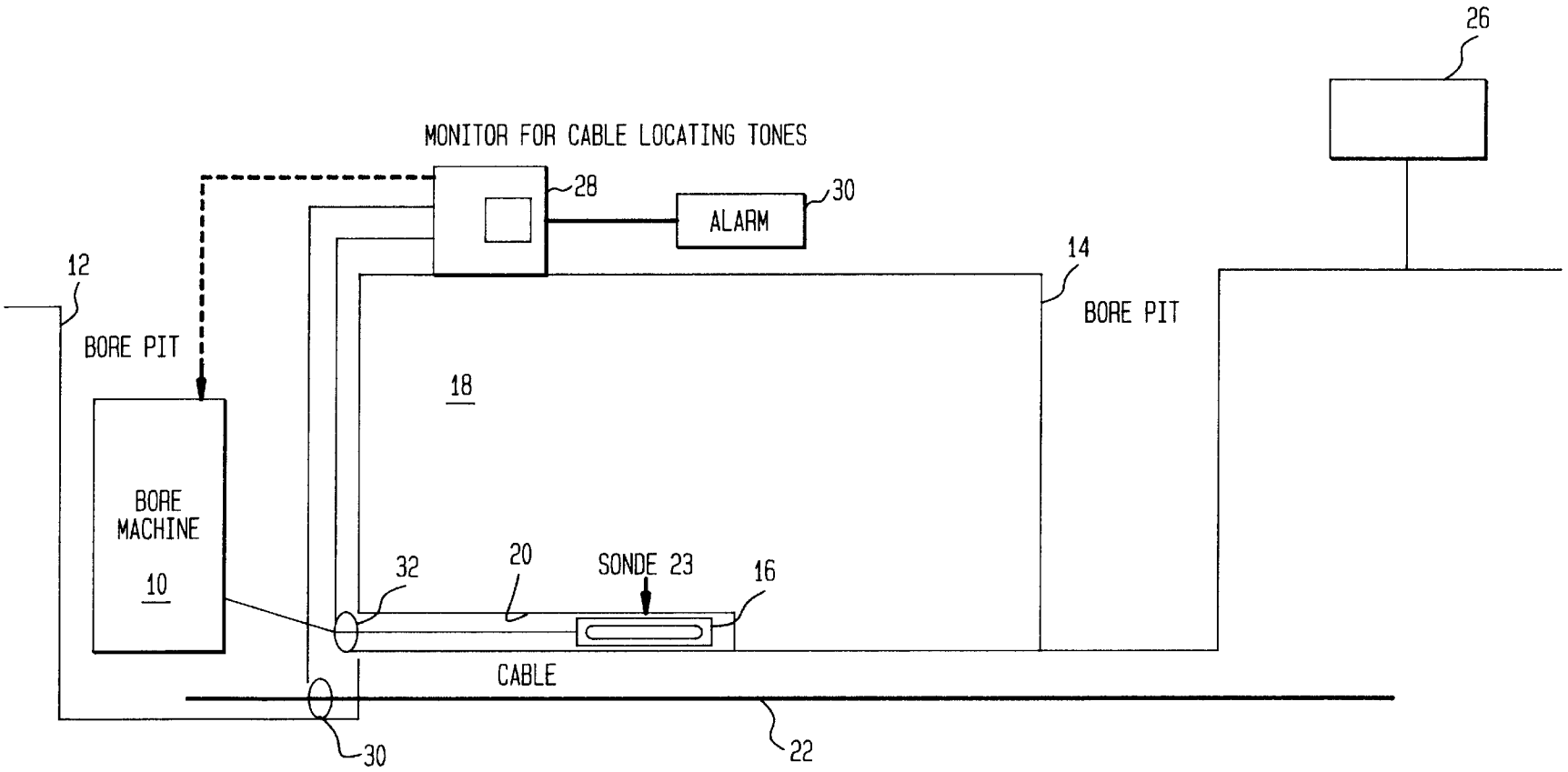
FIG. 1 shows an apparatus in accordance with the invention for both monitoring and controlling a boring head.

FIG. 1 depicts a boring operation conducted with the aid of a boring machine 10 known in the art. To complete a boring operation, a utility, such as AT&T, or its contractor, excavates first and second bore pits 12 and 14 at opposite ends of an intended path for a utility conveyance (not shown). Thereafter, the utility or contractor places the boring machine 10, in the first pit 12. An operator (not shown) operates the machine 10 to force a boring head 16 horizontally through that portion of the ground 18 between the boring pits 12 and 14. As boring machine 10 forces the boring head through the earth 18 from the first pit 12 into the second pit 14, the boring head creates a horizontal channel 20 for carrying a utility conveyance.

Often, a boring operation of the type described occurs in the vicinity of an existing conveyance 22, such as a fiber-optic cable. Since the boring operation occurs "blind," that is, without the ability to visually monitor the path of the boring head 16, the boring head may accidentally contact the fiber-optic cable 22, potentially damaging it. Presently, monitoring of the path of the boring head 16 is accomplished with the aid of a sonde 23 within the boring head for radiating a signal in the range of 33 Hz. to 9 kHz. One or more cable alert detectors 26 (see FIG. 1) are placed above the earth 18 and monitor the signal radiated by sonde 23, thereby providing an indication of the relative position of the boring head 16.

In practice, the signal radiated by the sonde 23 induces a like signal in other facilities, such as a metal sheath (not shown) surrounding the fiber-optic cable 22. In turn, the metal sheath of the fiber-optic cable 22 radiates the induced signal to other facilities. As a result, the receiver(s) 26 receive the signal radiated by such other facilities along with the signal radiated by the sonde 23. Hence, the receiver(s) 26 may not accurately determine the relative position of the boring head 16. Not knowing the relative position of the boring head 16 can prove disastrous, especially when the boring operation occurs in close proximity to existing utility conveyances, such as the fiber-optic cable 22.

To avoid the foregoing disadvantage, the present invention provides a technique for generating an alert when the boring 16 becomes too close to (i.e., within a minimum allowable distance from) the existing fiber-optic cable 22. The technique of the invention takes advantage of a locating signal that is radiated by the metal sheath of the fiber-optic cable 22. In practice, the sheath of the fiber-optic cable 22 carries at least one locating signal for the purpose of locating the cable in the manner taught by U.S. Pat. No. 5,644,237, issued Jul. 1, 1997, in the name of AT&T (herein incorporated by reference.) As will be discussed in greater detail below, the cable locating signal, and more particularly, its strength, serves as a point of reference for determining the relative position of the boring head 16 from the fiber-optic cable 22.

To ascertain the location of the boring head 16 relative to the fiber-optic cable 22, a differential signal monitor 28 receives on a first channel the signal radiated by the cable 22. In practice, the signal monitor 28 receives the signal through an inductive clamp 30 adapted for releasable engagement about the cable. Such inductive clamps are well known, and are exemplified by the type associated with current measurement devices. A second inductive clamp 32, of a construction similar to the clamp 30, couples the locating signal induced in the boring head 16 from the fiber-optic cable 22 to the signal monitor 28.

The signal monitor 28 compares the strength of the signal induced in the boring head 16, as detected via the clamp 32, relative to the strength of the locating signal at the fiber-optic cable 22, as detected via the clamp 30. The signal monitor utilizes the strength of the locating signal at the fiber-optic cable 22 as a reference value against which the strength of the signal received at the boring head 16 is compared. The strength of the locating signal induced in the boring head 16 generally varies inversely with the distance of the boring head from the fiber-optic cable 22. Thus, the closer the boring head 16 is to the fiber-optic cable 22, the greater the strength of the locating signal induced in the boring head. Conversely, the farther the boring head 16 is from the fiber-optic cable 22, weaker the signal induced in the boring head. However, strength of the locating signal on the fiber-optic cable 22 itself influences the strength of the signal induced in the boring head 16. Hence, it is necessary to take account of the strength of the locating signal when examining the strength of the locating signal induced in the boring head 16.

The signal monitor stores a reference value representing the ratio of the strength of the signal induced in the boring 16 to the strength of the locating signal at the fiber-optic cable 22 obtained when the boring head 16 is no closer to the fiber-optic cable 22 than the minimum allowable distance. Should the ratio of the strength of the locating signal detected at the boring head 16 to the strength of the locating signal at the fiber-optic cable 22 exceed the reference value, then the signal monitor 28 knows that the boring head is too close to the cable. Under such conditions, the signal monitor 28 actuates an alarm 30 that generates an alert, either in the form of a visual and/or audible warning, to apprise the operator of the boring machine 10 of the close proximity of the boring head 16 to the fiber-optic cable 22. Upon generation of the warning by the alarm 30, the operator of the boring machine 10 presumably takes appropriate action to avoid damaging the fiber-optic cable 22.

In addition to generating the warning signal 30 to the alarm 30, the signal monitor may also generate a control signal (represented by the dashed line in FIG. 1) to control the boring machine 10. The signal monitor 28 generates the control signal in accordance with the ratio of the strength of the locating signal detected at boring head 16 to the strength of the locating signal detected at the fiber-optic cable 22. In a feedback loop fashion, the boring machine 10 controls the operation of the boring head 16 to maintain the boring head 16 substantially parallel to the fiber-optic cable 22 at a prescribed separation distance therefrom in accordance with the control signal. If the control signal increases beyond a quiescent level that corresponds to the prescribed separation distance of the boring head 16 from the fiber-optic cable 22, the boring machine 10 displaces the boring head away from the cable. As a consequence, the signal monitor 28 reduces the strength of the control signal, causing the boring machine 10 to displace the boring head closer to the fiber-optic cable 22. As the boring head 16 moves closer to the fiber-optic cable 22, the control signal magnitude increases, causing the boring machine to displace the boring head away from the cable. By this process, the boring machine 10 controls the displacement of the boring head 16 so that the boring head bores substantially parallel to the fiber-optic cable 22.

The foregoing describes a technique for providing an alert when the boring head is within a minimum allowable distance from an existing underground utility conveyance, as well as for controlling the operation of the boring head to bore substantially parallel to the existing conveyance.

What is claimed is:

1. A method for providing an alert during a boring operation when a boring head is within a minimum allowable separation distance from an existing underground utility conveyance that radiates a locating signal of a pre-selected strength, comprising the steps of:

(a) detecting, at the utility conveyance, the strength of the locating signal;

(b) detecting, at the boring head, the strength of the locating signal radiated by the utility conveyance and induced in the boring head;

(c) determining if the strength of the locating signal detected at the boring head exceeds a prescribed fraction of the strength of the locating signal detected at the utility conveyance; and if so (d) generating an alert to indicate that the boring head is within the minimum allowable separation distance.

2. The method according to claim 1 wherein the alert is a visual alert.

3. The method according to claim 1 wherein the alert is an audible alert.

4. The method according to claim 1 wherein the alert comprises the combination of an audible and visual alert.

5. The method according to claim 1 further including the step of controlling the boring head during the boring operation in accordance with the ratio of the strength of the locating signal detected at the boring head to the strength of the locating signal detected at the utility conveyance.

6. A method for controlling a boring head during a boring operation to maintain the boring head substantially parallel to an existing underground utility conveyance that radiates a locating signal of a pre-selected strength, comprising the steps of:

(a) detecting, at the utility conveyance, the strength of the locating signal;

(b) detecting, at the boring head, the strength of the of the locating signal radiated by the utility conveyance and induced in the boring head;

(c) generating a control signal in accordance with a ratio of the strength of the locating signal detected at the boring head to the strength of the locating signal detected at the utility conveyance;

(d) displacing the boring head during the boring operation relative to the existing utility conveyance in accordance with the control signal such that the control signal remains substantially constant.

7. The method according to claim 6 further including the step of generating an alert when the ratio of the strength of the locating signal detected at the boring head to the strength of the locating signal detected at the utility conveyance exceeds a prescribed value.

8. The method according to claim 7 wherein the alert is a visual alert.

9. The method according to claim 7 wherein the alert is an audible alert.

10. The method according to claim 7 wherein the alert comprises the combination of an audible and visual alert.

11. Apparatus for providing an alert during a boring operation when a boring head is within a minimum allowable separation distance from an existing underground utility conveyance that radiates a locating signal of a pre-selected strength, comprising:

(a) means for detecting, at the utility conveyance, the strength of the locating signal;

(b) means for detecting, at the boring head, the strength of the locating signal radiated by the utility conveyance and induced in the boring head;

(c) means for determining if the strength of the locating signal detected at the boring head exceeds a prescribed fraction of the strength of the locating signal detected at the utility conveyance; and (d) means generating an alert to indicate that the boring head is within the minimum allowable separation distance.

12. Apparatus for controlling a boring head during a boring operation to maintain the boring head substantially parallel to an existing underground utility conveyance that radiates a locating signal of a pre-selected strength, comprising the steps of:

(a) means for detecting, at the utility conveyance, the strength of the locating signal;

(b) means for detecting, at the boring head, the strength of the of the locating signal radiated by the utility conveyance and induced in the boring head;

(c) means for generating a control signal in accordance with a ratio of the strength of the locating signal detected at the boring head to the strength of the locating signal detected at the utility conveyance;

(d) means responsive to the control signal for displacing the boring head during the boring operation relative to the existing utility conveyance in accordance with the control signal such that the control signal remains substantially constant.

13. The apparatus according to claim 12 further including means for generating an alert when the ratio of the strength of the locating signal detected at the boring head to the strength of the locating signal detected at the utility conveyance exceeds a prescribed value.

* * * * *